United States Patent [19]

Aidlin et al.

[11] 3,986,323

[45] Oct. 19, 1976

[54] APPARATUS FOR GUIDING AND POSITIONING CLOSURES ON CONTAINERS

[75] Inventors: Samuel S. Aidlin, Brooklyn; Stephen H. Aidlin, West Hempstead; Melvin Hartzog, Brooklyn; John C. Shepard, Jamaica, all of N.Y.

[73] Assignee: Aidlin Automation Incorporated, Brooklyn, N.Y.

[22] Filed: Apr. 29, 1975

[21] Appl. No.: 572,853

Related U.S. Application Data

[63] Continuation of Ser. No. 421,745, Dec. 5, 1973, abandoned.

[52] U.S. Cl. ..... 53/314; 53/317; 53/331.5

[51] Int. Cl.[2] ..... B65B 7/28; B67B 3/20

[58] Field of Search ..... 53/313, 314, 315, 316, 53/317, 331.5, 318

[56] References Cited

UNITED STATES PATENTS

| | | | |
|---|---|---|---|
| 2,072,245 | 3/1937 | Cuthbert et al. | 53/314 |
| 2,734,672 | 2/1956 | Day et al. | 53/314 X |
| 2,855,736 | 10/1958 | Harmon et al. | 53/313 X |
| 2,909,879 | 10/1959 | Hohl et al. | 53/331.5 |
| 3,012,388 | 12/1961 | Stover | 53/315 |
| 3,477,202 | 11/1969 | Zetterberg | 53/315 |
| 3,623,292 | 11/1971 | Barnes | 53/317 X |
| 3,849,973 | 11/1974 | Zetterberg | 53/317 X |

*Primary Examiner*—Travis S. McGehee
*Assistant Examiner*—Horace M. Culver
*Attorney, Agent, or Firm*—Martin Smolowitz

[57] ABSTRACT

An apparatus for directing and seating a closure having abutments disposed about its interior periphery, with a container having mating grooves for receiving such closure. The preferred embodiment employs an overhead adjustable belt for correctly positioning and guiding the closure onto a moving container by applying a continuous downward force across the top of the closure once it comes to rest upon the container. The container in turn is caused to be contacted at its periphery by a rotating belt and a back-up stationary surface. The resultant torque imparted thereto urges, the container to turn and positively engage and lock with the closure abutments.

An alternate embodiment, employs a knurled roller disposed along the container-closure line of travel for initially positioning the closure on the container by engagement with the closure at its periphery. A frictional pawl further upstream, contacts the already positioned closure to cause initial locking between the closure abutments and container grooves. Finally, the closure-container unit is acted upon by a pair of rotating conically shaped rollers also disposed in the line of travel, so as to finally lock the closure to the container. This embodiment makes use of an adjustable overhead guide assembly for controlling vertical movement of the closures as they are positioned to the containers.

4 Claims, 6 Drawing Figures

APPARATUS FOR GUIDING AND POSITIONING CLOSURES ON CONTAINERS

This is a continuation of application Ser. No. 421,745, filed Dec. 5, 1973, now abandoned.

This invention relates to an apparatus for guiding and positively seating a cap or other suitable closure onto a container. More particularly, the present invention is directed to a guiding and positioning apparatus for a child safe type container especially during the container capping operation.

It is well known that a class of containers and closures exist which are particularly designed to minimize the accidental opening of same by small children. Such containers do not open in the conventional manner, but rather require more than mere twisting of the closure. Basically, these containers and their closures are designed to form a locking arrangement of sorts necessitating for example, a downward force on the closure with an associated twist, or disengagement of the closure from a groove integral with the container, which in turn, is adapted to receive a lug for positive locking therein. A common characteristic of the closure portion of such container is the fact that its outer periphery is usually grooved or abraided in some fashion to allow the user to firmly grip same and enable removal from the container.

During normal production operations, the container is usually filled with ingredients at a first station and is subsequently conveyed to meet with and receive its closure from whence the sealed container proceeds for further handling such as labeling, counting, packaging, etc.

The present invention is directed especially to the placement and sealing of the container with a closure of the type described above. Up to the present invention, problems have arisen in such operations due to the improper placement and subsequent poor seating of the closure to the container. This in turn has caused production jam-ups and deformed containers. Furthermore, excessive force applied to the closure surfaces during the seating and twisting of such closure onto the container, has tended to mark and cosmetically injure the closure and/or container itself.

Failure to provide the correct amount and type of closure guidance in its course of travel as well as, appropriate torsional force as the closure is being disposed on its corresponding container, has lead those skilled in the art to evolve closure positioning assemblies which are quite complex and yet fail to meet the high standards of reliability.

Accordingly, it is the main object of the present invention to provide an apparatus free from t h e defects of the prior art.

A further object of the present invention is to provide a simple and highly efficient apparatus for the positive closure of a closure upon a container.

Still another object of the present invention is to provide an apparatus for guiding and positively seating a closure on to a child safe container.

Yet a further object of the present invention is to provide an apparatus suitable for use with an abraided container closure during the seating and sealing of such closure to a container.

Still another object of the present invention is to provide an apparatus for seating a closure to a container employing guidance means and the application of a torsional force to the closure in order to firmly position it on the container.

Still another object of the present invention is to provide a simple, trouble free apparatus allowing for a high volume closure applications to containers during the transfer of such container from one work station to another.

More particularly, the principal features of the present invention are directed to apparatus having positioning and guidance means for placement of a closure upon a container being open at one end, including: means for conveying said container from a source of supply; means for conveying said closure from a source of supply; means for urging said closure to seat and positively engage said container to thereby form a fixedly separable closure-container unit; conveying means for conveying said closure-container unit from a first station to another further upstream in its course of travel; closure guidance means disposed in proximity to that point where said closure and said container are caused to meet in their respective lines of travel, for initially orienting said closure with respect said container; positioning means disposed along the said unit conveying means, for applying a restraining force upon said closure as such closure-container unit is being conveyed; and means for imparting a relative torque with respect to the respective component of said closure-container unit, causing said closure to finally engage and lock with said container.

Also within the scope of the invention is an apparatus wherein: said positioning means includes an endless flat belt disposed above the line of travel of said closure-container unit and being in intimate contact with said closure for imparting thereon a continuous downward seating force. The invention also includes means for imparting relative torque to the closure container unit, comprising a rotating endless belt in cooperative working relationship with a complimentary back-up surface, whereby said rotating belt engages said container at its periphery and urges said container to rotate with respect to said closure.

These and other objects of many of the attendant advantages of this invention will be readily appreciated as the same becomes better understood by reference to the following detailed description when considered in connection with the accurate drawings in which.

Figures 1, 2, 3:
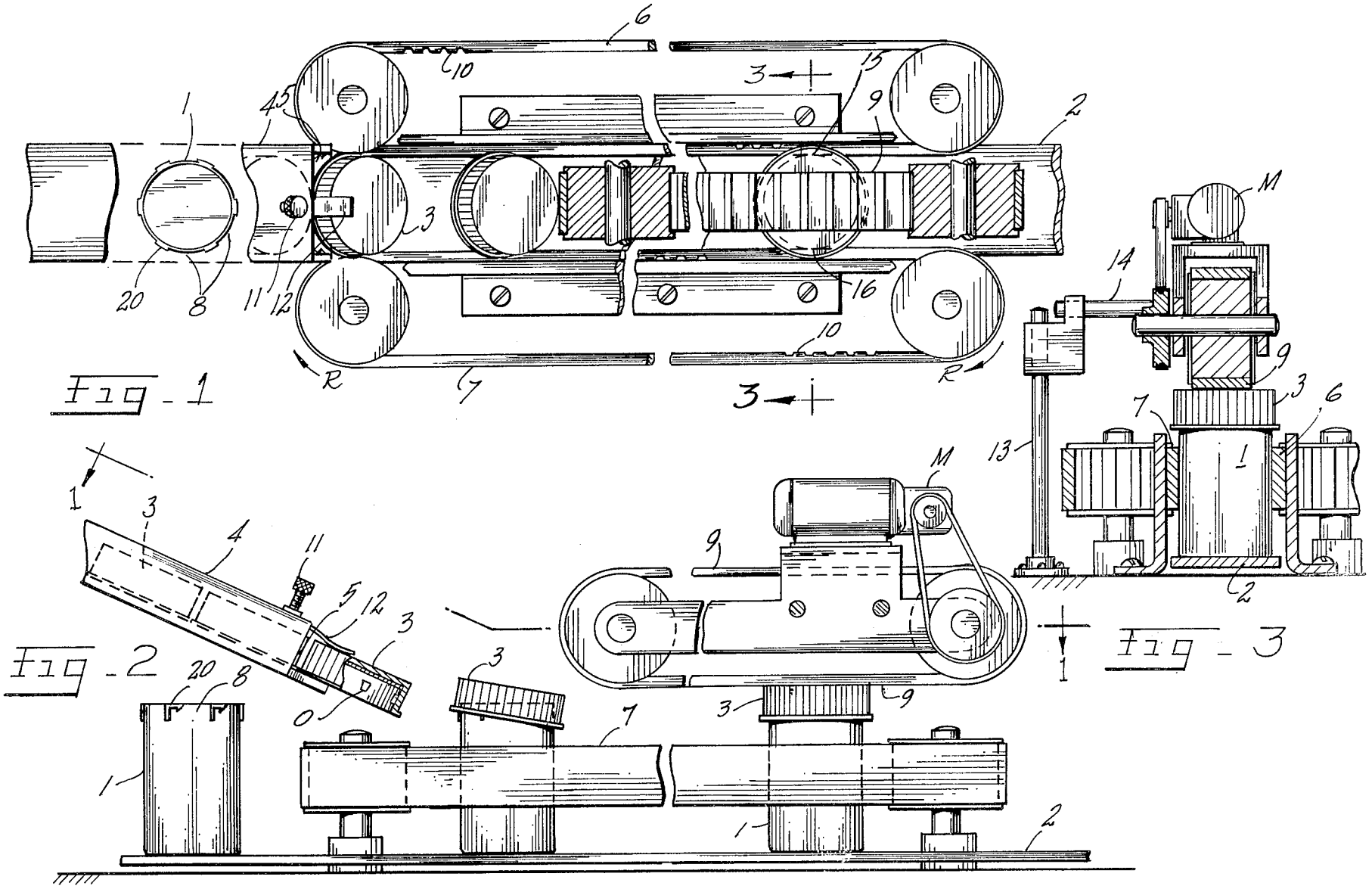
FIG. 1 is a plan view of a preferred embodiment of the apparatus.
FIG. 2 is a front elevation of the inventive apparatus shown in FIG. 1.
FIG. 3 is a partial sectional view taken along 3—3 of FIG. 1.

According to FIG. 1, as containers 1 travel along a conveyor belt 2, their counterpart closures 3 are being conveyed from a source of supply 4 in a sequential manner through an escapement of a type that is commercially available. For example, a supply hopper of a conventional type (not shown) dispenses and gravity feeds container closures 3 down an inclined chute 4 provided with an escapement 5 at its exit end. Simultaneously, containers 1 are being transported in the forward direction by a pair of side gripper belts 6, 7. Essential to high volume trouble free production runs is the proper placement and seating of the closure 3 with the container 1 (with or without ingredients) during their forward advance. The inventive apparatus provides the necessary guiding and working members for carrying out this operation.

More particularly, as the closures 3 are dispensed and pass through the escapement 5 they are urged to sit on the top portion of the container (see FIG. 2).

By way of explanation, the present apparatus and its operation is described with respect to the placement of a closure 3 containing a series of abutments or ridges 0 serially disposed about its interior periphery on container 1. Such abutments are intended to cooperate with a series of notches or locking grooves 20 integral with the container 1 and correspondingly spaced around the top along the outer periphery of container 1. Thus, during the initial positioning operation, the closure abutments 0 will either-clear the spaces 8 between the notched areas and thereby seat therebetween or come to rest in a position whereby the abutments sit on such notches on a one-to-one basis. In the later case, the closure 3 is not very stable on the container 1. In either event, the present invention performs a number of mechanical operations to both the closures 3 and/or container 1 thereby providing continuous positive control over the orientation and disposition of the closure 3 to the container 1 after its travel out of the chute 4.

As the closure-container unit shown in FIG. 2, continues in its travel, the closures 3 are individually urged to assume a definite position at the top of the container 1 by means of the apparatus of the invention which is disposed along the path of forward travel of the closure container unit.

The preferred embodiment of the present invention employs an overhead belt 9 in cooperative working relationship with one of two motor driven belts 6,7 provided with gripper segments 10. More specifically, the overhead belt 9 is positioned above the line of travel of the container closures 3 at a point after they are gravity fed and exit out of the chute escapement 5. The escapement 5 is provided with an adjustment screw 11 for varying the tension on a hinge covered top of such escapement 5. In addition, the exit end of the escapement is provided with an extending longitudinal member 12 made of a suitable spring steel. Such extending member 12 serves to guide and position the closure 3 as it exits the chute 4 and thereby minimize any erratic or uncontrolled movement of the closure 3 from such chute 4. The closure 3 travels at a rate so that it initially comes to rest upon a mating container 1 travelling at a comparable speed and both commence to be conveyed.

Subsequently, the closures 3 comes under the action of an overhead belt 9 and the container is caused to be rotated by one of the container gripper belts 7.

To specifically guide and positively position the closure 3 on to the container 1, the present invention employs an overhead motor driven pressure belt 9 which is suitably held in place by support brackets 14 (see FIG. 3). This belt 9 extends above the container conveyor along a pre-defined course of travel which, for example, may extend from the point of exit of the chute escapement, up to and including a point further upstream near the terminus of the gear belt grippers. The overhead belt 9 is adjustable in the vertical direction along suitable ways 13, to enable it to function with different sizes of containers. The overhead belt 9 is driven by suitable motor means M at a speed comparable to that of the rate of travel of the container 1 with closure 3 thereon.

Of the two gripper belts 6,7 which serve to convey the the closure-container unit from one station to another, one such belt 6 during the final closure positioning operation is de-energized and does not rotate; whereas, the second belt 7 in cooperation with the non-rotating belt 6 providing a back-up surface at, for example, 15 to engage the container 1 as downward pressure is exerted across the top surface of the closure 3 by the belt 9 (See FIG. 3). By means of such cooperative action, a downward force is maintained on the closure 3 at all times and concurrently therewith, the container 1 is caused to rotate in a manner resulting in closure 3 locking with container 1. What results after such action, is positive seating and engagement of the closure abutment 0 with the associated locking grooves 7 at the periphery of the container 1. To achieve the aforementioned, the energized gripper belt 7 is caused to engage the container at its periphery at point 16 for example and urge it to turn in the counter-clockwise direction R (such belt 7 is on the right side of the apparatus as one is looking in the direction of movement of conveyor 2). At this moment, the container 1 is engaged by two cooperative surfaces with the non-moving belt 6 providing a back-up surface and the rotating belt 7 imparting sufficient rotational force to the container 1 to cause closure abutments 0 to completely seat into corresponding grooves 20 disposed about the periphery of the container 1.

It is apparent that by employing the combination of an overhead adjustable pressure belt 9 (after suitable adjustment for container size) the invention provides a continuous downward force on the closure-container unit plus cooperative guide means for controlling the movement of such closure 3 with respect to its corresponding container 1. By the action of the active belt surfaces 15, 16 on the container periphery, a requisite locking force is generated. Obviously, the amount of torsional force imparted by the rotating belt 7 substantially controls the magnitude of the torsional force imparted to the container 1 and ultimately the degree of lock between closure 3 and container 1.

An alternate embodiment of the invention employs another approach whereby a knurled roller in cooperation with several other operative members act upon the closure-container combination.

Figures 4, 5, 6:
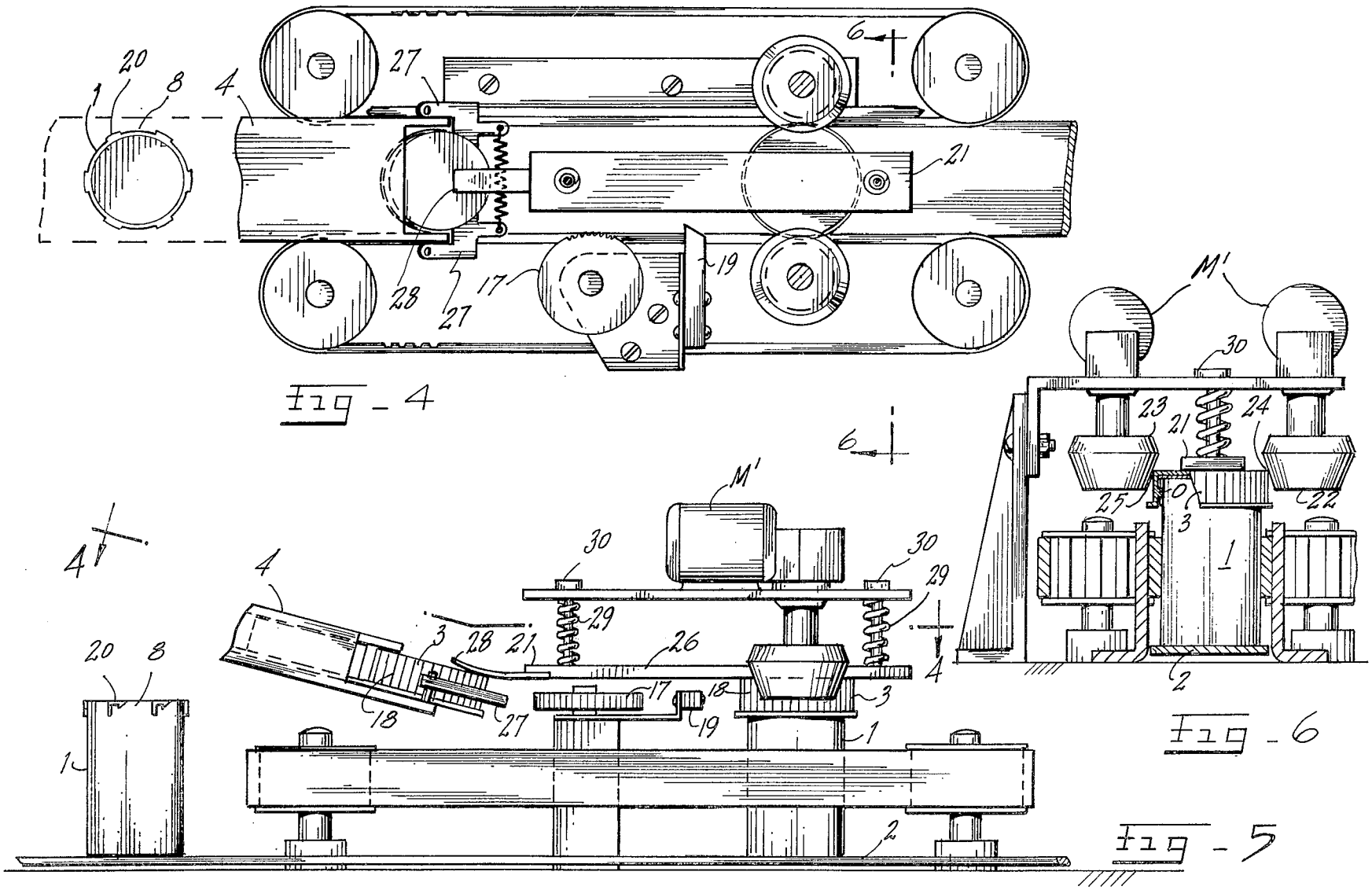
FIG. 4 is a plan view of an alternate embodiment of the inventive apparatus.
FIG. 5 is a front elevation of the inventive apparatus shown in FIG. 4.
FIG. 6 is a partial sectional view taken along 4—4 of FIG. 5.

According to the arrangement, as shown in FIG. 5, a knurled roller is employed to positively place the closure 3 on the container 1 for seating thereon after the closure 3 has been fed downwardly from chute 4, as described above. By engaging the abraided peripheral surface 18 of the closure 3, the knurled roller 17 provides the initial engaging momentum for correctly positioning the closure 3 with respect to the container 1 travelling along conveyor belt 2. As the closure-container combination continues in its forward travel, it is conveyed until the closure 3 is engaged at a point about its outer periphery by the working surface of a frictional stationary rubber pawl 19 (See FIG. 4). The pawl serves to engage and rotate the closure 3 under a controlled force in a manner sufficient for establishing partial engagement of the closure abutment with a corresponding container locking notch 20 while at the same time, not damaging the closure at the contact surface 18. The closure 3 and container 1 are further controlled and constrained by means of an elongated spring loaded guide assembly 21 which serves to minimize the vertical movement of the closure 3. As shown in FIG. 6, the closure-container combination travelling further downstream, is urged between a pair of counter-clockwise rotating conically shaped sloping rollers 22, 23. Here, the outer abraided portion 18 of the closure 3 is placed into contact with the rollers 22, 23 along such sloping surfaces 24, 25 so as to simultaneously transmit a downward and torsional or twisting motion to the closure 3 at the points of contact. The rollers 22, 23 are directly driven by constant speed motors M′ and are kept rotating so as to provide a balanced downward pressure on the closure 3 at all times.

The co-action between the rollers 22, 23 and the closure 3 is vitally important especially in the case where the closure 3 fails to remain on the top portion of the container 1 and is askew. Looking more closely at such an occurence, experience indicates that the closure 3 would tend to sit to one side; therefore, a countervaling force on the up-ended side of the closure 3 is necessary in order to impart an opposing downward pressure, thus forcing the closure into its proper position on the container. To assure such cooperative action, the invention contemplates two rotating conically shaped rollers 22, 23 capable of providing the requisite downward force on the closure 3. Such rollers 22, 23 can be constructed of metal or other suitable material.

The over-hanging guide assembly 21 extending from the closure escapement 27 to a point further upstream is provided with suitable elongated spring loaded major guide member 26 which is positioned centrally over the line of container travel. This guide assembly 21 includes another guide segment 28 having a flat spring portion integral therewith disposed at the end closest the chute 4 (i.e., see lead line 28) projecting in a manner to restrain the vertical movement of exiting closure 3. The guide segment 28 forms a continuation of and leads into the major guide member 26 so as to fair in and stabilize the container movement; thus, preventing tipping while at the same time minimizing uncontrolled and undesirable upward travel of the closure 3. The major guide member 26 being spring loaded serves as a floating guide by providing sufficient tolerance or play via springs 29, so as to compensate for any eccentricity in the position of the closure 3 on the container 1. Furthermore, the guide assembly 21 is adjustable in a vertical plane along adjusting screws 30, to allow for handling different sizes of containers.

The present invention is particularly suited for continuous trouble free volume runs since guidance and downward urging of the closure, as well as, the twisting or torsional work is accomplished while the closure container unit is in motion on a conveyor or the like.

While the above-described apparatus of the present invention has been presented primarily with respect to its application for the positive seating and closure of child safe containers, it is, of course, obvious tht such apparatus disclosed and illustrated above, can be employed to provide closure of other types of containers and caps. Accordingly, it should be understood that the foregoing relates not only to preferred and alternate embodiments of the invention, but is also intended to cover all changes and modifications of the invention herein disclosed for the portion of the disclosure, which do not constitute departure from the spirit and scope of the invention.

What is claimed is:

1. An apparatus for supplying and applying closures having a lip surface with a plurality of laterally spaced internal abutments integrally formed therewith, upon a container having a corresponding number of mating locking grooves for receiving said abutments, to thusly form individual closure-container units, said apparatus being adapted to firstly position and effectuate initial closure placement and to secondly provide final engagement respectively of said closures with said containers, including: means for conveying said containers from a source of supply; means for conveying said closures from a source of supply; closure guidance means disposed along the line of travel of said closure-container unit provided with a rotatable knurled roller member means adapted to engage said lip surface at the periphery and an associated elongated spring-loaded member in communication with the top surface of said closure; said spring loaded member being formed as a continuation of and leading from said source of supply of said closures; said guidance means being formed to simultaneously act on the respective closure surfaces for initial closure placement on said container by downward restraint and rotation of said closure with respect to said container; pawl shaped friction means disposed further downstream of said knurled roller means, along the line of travel of said closure-container unit, adapted to tangentially contact said closure lip surface to impart a rotational force of a magnitude sufficient to cause initial locking between said closure and said container; and a pair of rotatable frusto-conically shaped rollers disposed along the line of said closure-container unit beyond said pawl shaped frictional member, having inwardly tapered lower surfaces for providing balanced downward pressure on the lip surface by engagement therewith, causing said closure to move and urge said container grooves into final locking engagement with said abutments.

2. An apparatus as claimed in claim 1, wherein said spring loaded member includes an integrally formed resilient portion projecting upwardly and over said means for conveying said closures to thereby restrain vertical movement of exiting closures.

3. An apparatus as claimed in claim 1, wherein said closure guidance means is defined by an elongated spring loaded floating member extending along the length of travel of said closure-container unit, being provided with vertical axis adjustment means to thusly enable said guidance means to be adjusted for specific sized containers and to compensate for any eccentricity in the disposition of said closure on said container by the application of a downward force across the top surface of said closure.

4. An apparatus as claimed in claim 1, wherein said rotatable frusto-conically shaped rollers rotate in a counter-clockwise direction.

* * * * *